US006870942B1

(12) United States Patent
Graber

(10) Patent No.: US 6,870,942 B1
(45) Date of Patent: Mar. 22, 2005

(54) LOUDSPEAKER FOR LINE ARRAY SOUND SYSTEM

(76) Inventor: Curtis H. Graber, 9301 Roberts Rd., Woodburn, IN (US) 46797

( * ) Notice: Subject to any disclaimer, the term of this patent is extended or adjusted under 35 U.S.C. 154(b) by 0 days.

(21) Appl. No.: 10/654,050

(22) Filed: Sep. 3, 2003

(51) Int. Cl.[7] ..... H04R 25/00

(52) U.S. Cl. ..... 381/349; 381/182; 381/342; 381/345; 181/144

(58) Field of Search ..... 381/339, 351, 381/352, 160, 300, 302, 304–305, 86, 89, 332, 335, 340, 342, 345–349, 353–354, 182, 186; 181/152, 159, 160, 144–145, 147, 199

(56) References Cited

U.S. PATENT DOCUMENTS

| | | | | |
|---|---|---|---|---|
| 1,809,754 A | | 6/1931 | Steedle | |
| 4,041,446 A | | 8/1977 | Liebermann | |
| 4,344,504 A | | 8/1982 | Howze | |
| 4,924,504 A | | 5/1990 | Burton | |
| 5,163,167 A | | 11/1992 | Heil | |
| 5,546,468 A | * | 8/1996 | Beard | 381/86 |
| 6,112,847 A | | 9/2000 | Lehman | |
| 6,343,133 B1 | | 1/2002 | Adamson | |
| 6,393,129 B1 | | 5/2002 | Conrad et al. | |
| 6,394,223 B1 | | 5/2002 | Lehman | |
| 6,535,612 B1 | | 3/2003 | Croft, III et al. | |
| 6,628,796 B2 | * | 9/2003 | Adamson | 381/342 |

* cited by examiner

*Primary Examiner*—Huyen D. Le
(74) *Attorney, Agent, or Firm*—Paul W. O'Malley; Susan L. Firestone

(57) ABSTRACT

A loudspeaker assembly includes a housing defining a bass-reflex enclosure. The housing has a trapezoidal cross-sectional shape in a vertical section running from front to back of the housing. A conventional low frequency cone woofer is mounted in an aperture in the front face of the enclosure. An elongated port is defined in part by one of the sides of the housing and its top and bottom sides. The elongated port has varying vertical and horizontal cross sectional dimensions to conform to the sides of the enclosure while maintaining a constant cross sectional area. A planar is mounted to the front face of the enclosure over a tuned rear chamber.

17 Claims, 5 Drawing Sheets

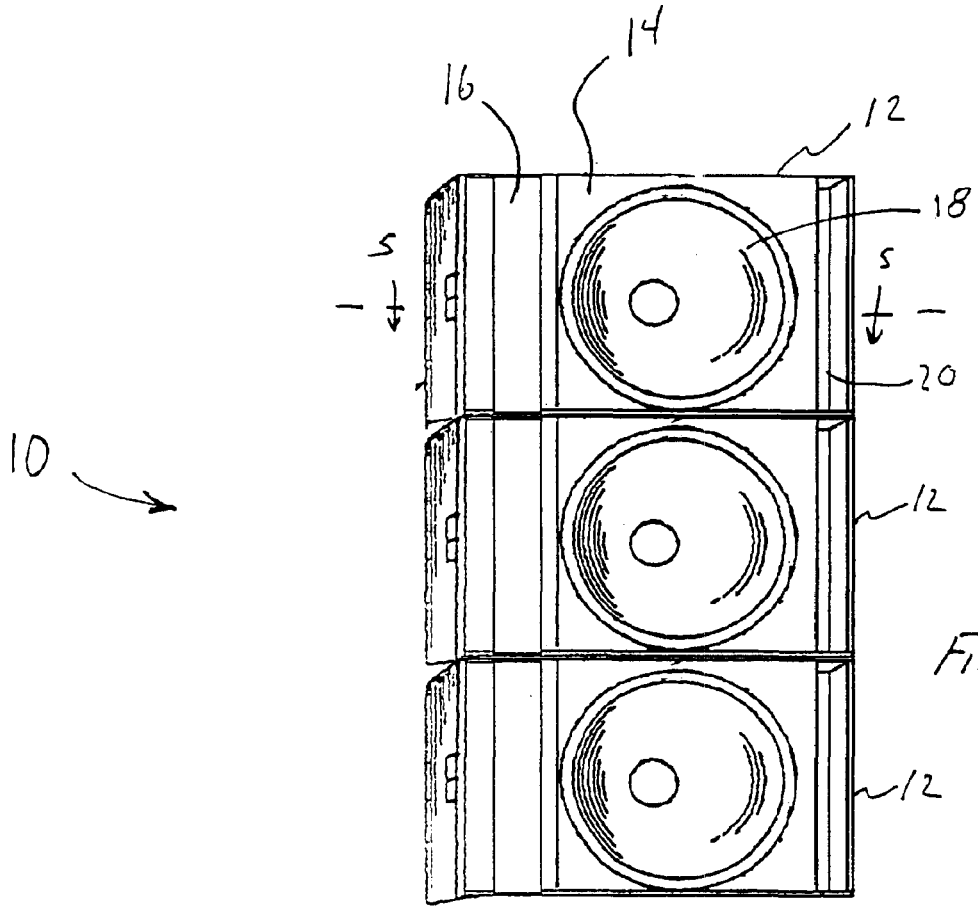
FIG. 1
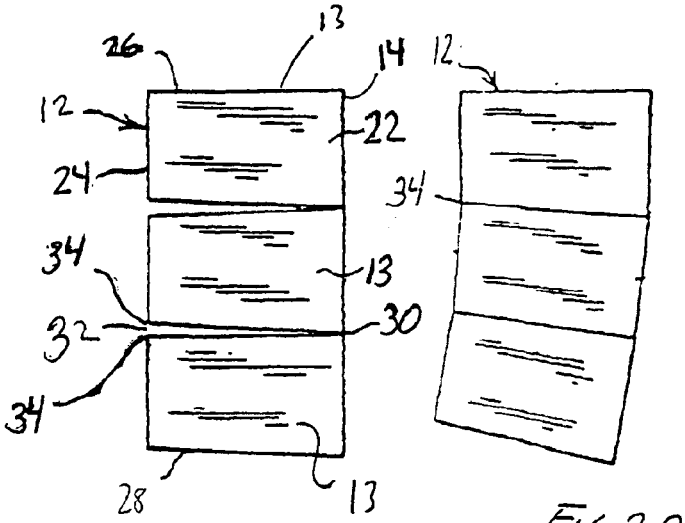
FIG. 2A
FIG. 2B

LOUDSPEAKER FOR LINE ARRAY SOUND SYSTEM

BACKGROUND OF THE INVENTION

1. Technical Field

The invention relates to an electro-acoustical devices and, more particularly, to a loudspeaker for use in constructing a line array of loudspeakers.

2. Description of the Problem

Large space, public sound systems rely on a combination of loudspeaker types to achieve efficiency, wavefront coherence, a broad and level audio frequency bandwidth and good coverage of an audience located in the space. A foundational element in many such public sound systems is a line array of multi-transducer loudspeakers. A line array, in its classical form, consisted of a vertical row of "closely spaced", cone type, direct radiator acoustical drivers set in a baffle. In this arrangement adjacent acoustical drivers are mutually coupled to reduce the spread of the sound in the plane comprising the axis of alignment of the drivers and to promote even diffusion of the sound energy in an expanding half cylinder having the axis of alignment as its center. Since line arrays are typically oriented vertically, this means that sound reproduced has a minimal vertical spread and enhanced horizontal audio qualities and exhibit greater efficiency.

Mutual coupling of the acoustic drivers results from the acoustic drivers being identical, producing the same sounds and being closely spaced. What constitutes "closely spaced" is a function of the highest audio frequency that the array is intended to produce, but roughly means that the center of each speaker cone should be spaced from adjacent cones by no more than a quarter wavelength of the highest frequency sound the array is intended to reproduce. Audible sound ranges in wavelengths from about 17 meters at 20 hertz to 1.7 cm at 20 Kilohertz. The smallest direct radiator speakers used are usually on the order 10 cm. allowing sound reproduction up to a frequency of about 3 Kilohertz. This provides for good speech intelligibility but is less suitable for amplification of music into large spaces.

The prior art exhibits repeated attempts to provide line arrays capable of reproducing the highest discernable frequencies by constructing devices which emulate certain characteristics of ribbon or "planar" type devices. Ribbon type audio transducers date back to the early twentieth century. An example of an early ribbon type audio transducer is disclosed in U.S. Pat. No. 1,809,754 for an "Electrostatic Reproducer" to Steedle. Ribbon devices resemble an elongated flat panel and produce sound from a vibrating flat surface. In effect a ribbon or planar is a line array of infinitesimal elements positioned directly adjacent one another, i.e. a line array having zero spacing between mutually coupled drivers. This in turn means that a planar has no practical upper frequency limit in the human audio range. Unfortunately, as observed by Adamson in U.S. Pat. No. 6,343,133, ribbon tweeters have had limits in sensitivity and power handling capacity preventing application of the devices in replacing high frequency compression drivers in systems for large spaces. Planars can also suffer from selective frequency cancellation due to out of phase reflection issues from the mounting enclosure used in linear array units.

Due in part to the perceived problems with planars, several attempts have been made to produce a device that behaves like a planer but is constructed using horn loaded, conventional mid or high frequency drivers. Such a device is usually intended to be used to reproduce sound over a broad frequency range. Precursors to and examples of these devices are represented by U.S. Pat. No. 4,344,504 to Howze, U.S. Pat. No. 5,163,167 to Heil, U.S. Pat. No. 6,343,133 to Adamson, and U.S. Pat. No. 6,394,223 to Lehman. The proposed systems have obtained some of the performance, high frequency fidelity and efficiency gains of a planar. However, horn loading introduces some distortion to sound reproduction. It would be desirable to produce a loudspeaker which overcomes the problems with incorporating ribbon devices used in line arrays and which minimizes the need to resort to horn loading to situations requiring greater output power than is currently the case.

SUMMARY OF THE INVENTION

According to the invention there is provided a multi-transducer loudspeaker assembly for use in line arrays in large audience settings. A preferred loudspeaker assembly includes a trapezoidal housing defining a bass-reflex enclosure. The housing's trapezoidal cross-sectional shape is in a vertical section running from front to back of the housing parallel to the primary axis of the array. A conventional low frequency cone woofer is mounted in an aperture in the front face of the enclosure. An elongated port for the woofer is defined in part by one of the sides of the housing and its top and bottom covers. The elongated port has varying vertical and horizontal cross sectional dimensions to conform to the sides of the enclosure while maintaining a constant cross sectional area. A planar is mounted to the front face of the enclosure over a acoustic reflection dampening indent on the front face.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a frontal view of several loudspeaker enclosures showing alignment of high frequency ribbon tweeters and exits for the low frequency sound;

FIGS. 2A and 2B are alternative arrangements of the loudspeaker enclosures.

DETAILED DESCRIPTION OF THE INVENTION

Figure 3:
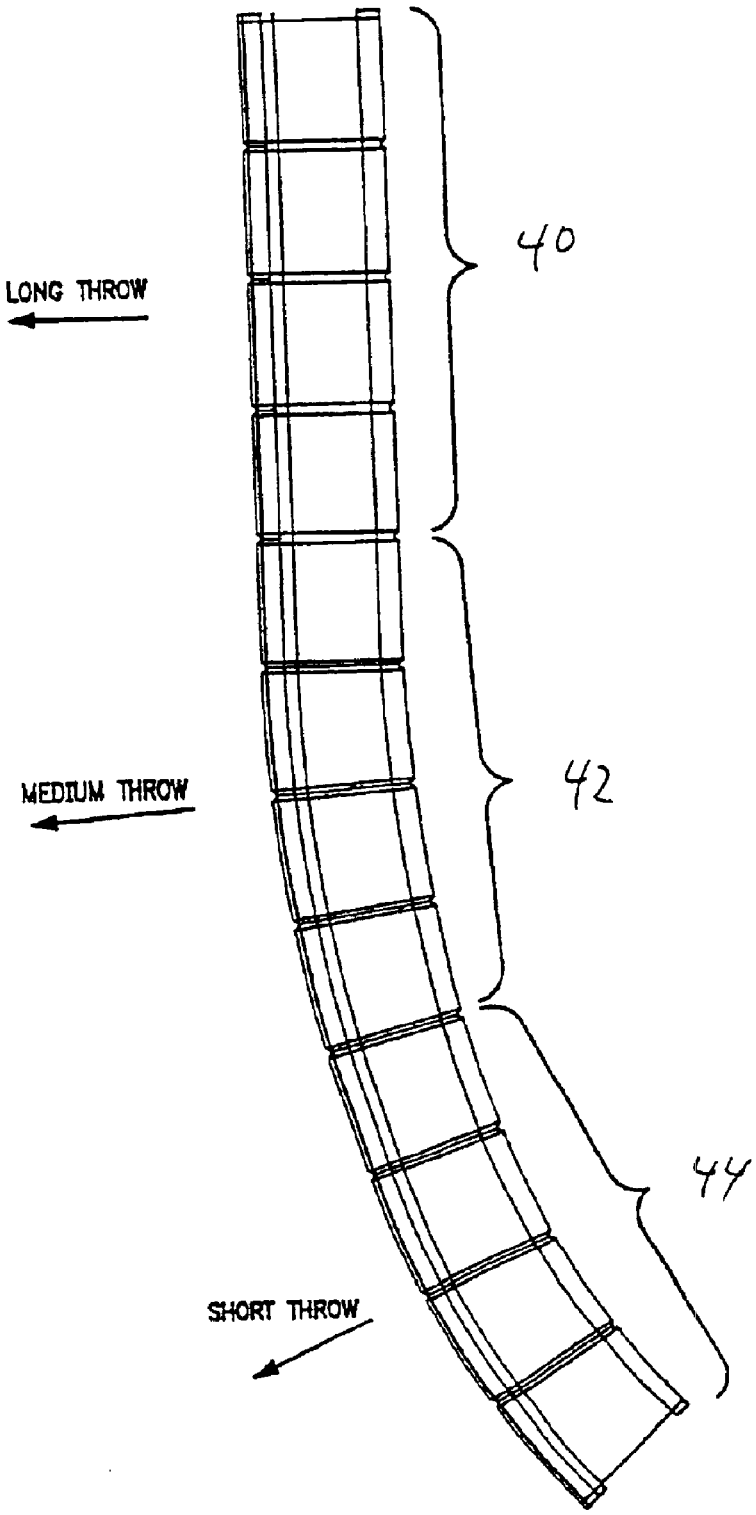
FIG. 3 is an array of loudspeakers incorporating the present invention.

Referring now to the figures and in particular to FIG. 1 where an array 10 of multi-transducer loudspeaker units 12 is arranged in vertical alignment one on top of another. Loudspeaker units 12 each have a front face 14 from which sound radiates from a high frequency planar or ribbon tweeter 16, a woofer 18, and a low frequency, elongated port 20. The particular types of transducers and ports for a loudspeaker unit 12 are aligned with like elements for adjacent loudspeaker units 12.

As may be seen in FIGS. 2A and 2B loudspeaker units 12 are disposed in trapezoidal housings 13. By trapezoidal it is meant that the housings 13 are characterized from bases 28 and upper covers 26 which converge from front to back of the units 12. This same shape is sometimes referred to as a trapezium. The front face 14 and back wall 24 are parallel giving each housing 13 a side on trapezoidal appearance. The individuals sides of a trapezoidal housing 13, such as side 22, are trapezoidally shaped with front and rear parallel edges and top and bottom converging sides. In practice, loudspeaker units 12 are arranged in a vertical plane, either straight up and down as shown in FIG. 2A, or in a curving manner such as shown in FIG. 2B, or, as is most typically the case where large volumes need to be covered, as a mixture of shapes (straight vertical 40, moderate curve 42, tight curve 44) as shown in FIG. 3. The more nearly straight the array, the greater the vertical compression of the sound output from the array for reaching distant portions of an audience. Whatever the curvature, the front faces 14 meet edge to edge 34 to maintain spacing between acoustic transducers. Along the back faces 24 the units 12 may be arrayed step wise in a curved fashion meeting along edges 34, or the units may be held vertically with a gap 32 between the trailing edges 34.

Figure 4:
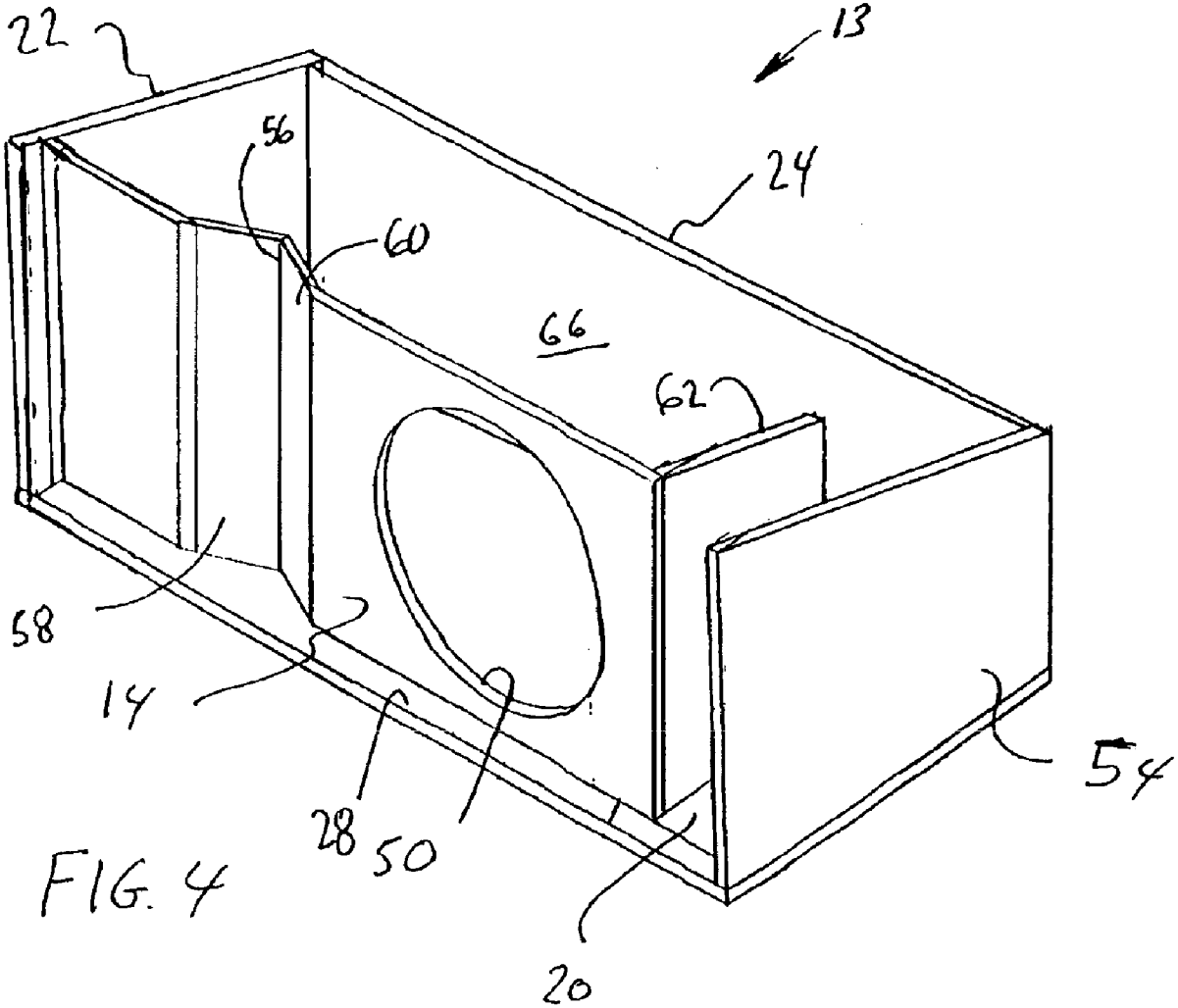
FIG. 4 is a perspective drawing of a housing for one of the loudspeaker enclosures of FIG. 1.

Referring to FIG. 4, housing 13 is shown with the top cover 26, planar 16 and woofer 18 removed to better illustrate some of the improvements of the present invention to the art. Housing 13 comprises a base 28 on which rise end walls 22 and 54 which run from front to back of the housing. End walls or sides 22 and 54 are trapezoidal in shape with the base of the trapezoid being disposed to rise vertically from the base 28 adjacent the opposite ends of front face 14. A shorter rear wall is disposed across the back of housing 14. A port 20 communicating with the interior of housing 13 is opened in front face 14. Base 28, cover 26, ported front face 14, rear face 24 and end walls or sides 22 and 54 define an elementary bass-reflex enclosure. Port 20 is an elongated port with a rectangular section, being defined between end wall 54, baffle 62, which is a vertical wall placed inside housing 13, and by the interior surfaces of base 28 and cover 26. Since cover 26 and base 28 converge on one another from front to back, elongated port 20 does not have a constant vertical dimension. To compensate for the constantly changing vertical dimension of port 20, baffle 62 is set obliquely with respect to end wall 54, the horizontal spacing between the two walls increasing from front to back. This allows the cross sectional area of port 20 to remain substantially constant from front to back.

An aperture 50 for a woofer is cut in front face 14. Port 20 provides a tuned outlet for sound from the reverse side of the woofer tuned by a bass-reflex enclosure 66. Also disposed on front face 14 is a vertical indent 56 comprising first and second canted faces 58 and 60. Typically, planars have been mounted in so-called infinite baffles with little to no effort has been made to provide these devices with a tuned rear chamber to extend the low frequency knee of the device. Indent 14 provides such a tuned rear chamber, extending the operating frequencies of the device down to the mid-frequency ranges. The depth of indent 14 should be approximately one quarter of a wavelength of the lowest frequency the planar is intended to produce. Faces 58 and 60 should intersect at an angle of between 30° and 60°. The effect is at the desired operating frequency no reflected standing wave is produced with sound output canceling properties. Housing 13 allows use elongated port 20 for the lowest frequency range to be produced, woofer 18 for low to mid range frequencies, and ribbon tweeter 16 for mid to high range frequencies.

Figure 5:
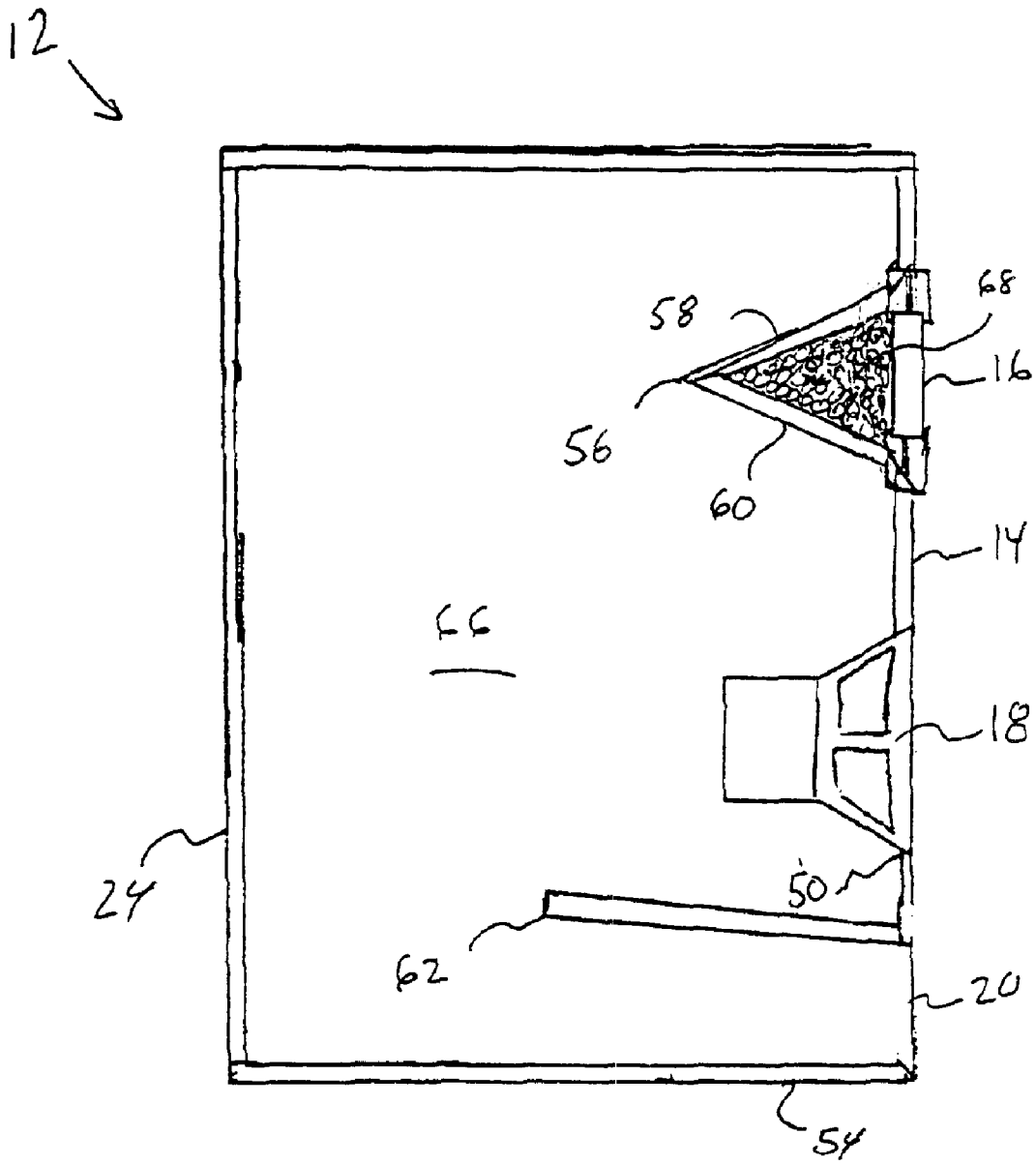
FIG. 5 is a cross sectional view of the loudspeaker housing along section line 5—5 in FIG. 1.
Figure 6A:
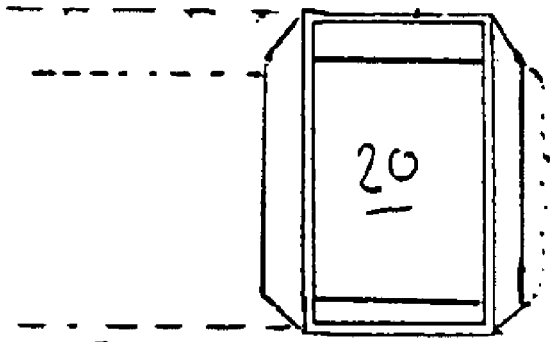
FIGS. 6A and 6B are a front elevation of an elongated port and a side elevation of a loudspeaker enclosure with the location of the same port shown in phantom.
Figure 6B:
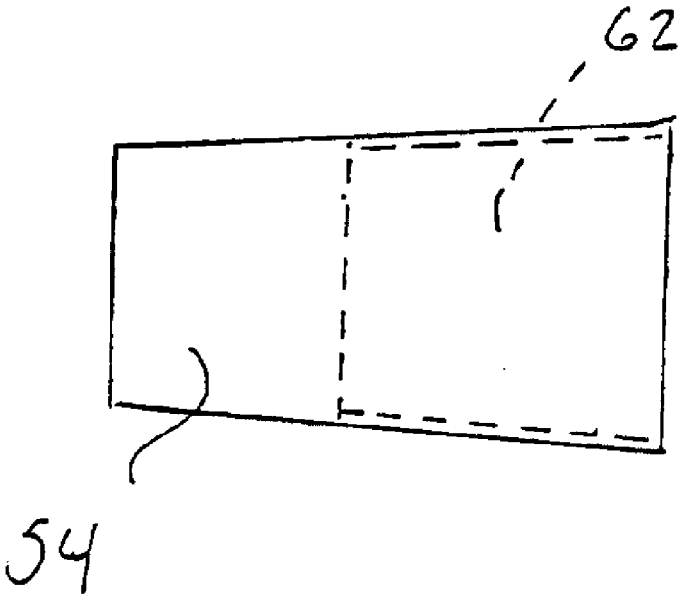

Referring to FIG. 5 a loudspeaker 12 is illustrated in cross section illustrating the positioning of the active elements. In a preferred embodiment of the present invention loudspeaker units 12 incorporate ribbon tweeters 16 in a high power line array. One difficulty in the prior art in utilizing ribbon tweeters has been the tendency of some of the output power to be lost at certain frequencies from reflection of sound emitted from the backside of the ribbon, reflected by the line array unit and combined out of phase with forward emitted sound. Planar or ribbon tweeter 16 is positioned over an elongated, V-shaped indent 56. Indent 56 is elongated in the direction of alignment of loudspeaker units 12. With planar 16 positioned over indent 16 a void with a triangular section perpendicular to the direction of elongation is formed. This void is filled with a sound dampening material 68 such as wool or a synthetic fiber to limit ringing. Woofer 18 is set in aperture 50. Between aperture 50 and end wall 54 is shown a baffle 62 which extends back into the enclosure from front face 14, but which does not reach back wall 24. The divergence of baffle 62 from wall 54 is illustrated. Elongated port 20 is formed between baffle 62 and wall 54. FIGS. 6A and B further illustrate the changing vertical and horizontal dimensions of elongated port 20.

The invention provides an improved line array element which incorporates a ribbon tweeter or planar element. The use of a tuning rear chamber improves output from the planar element and also extends its frequency operating range. The loudspeaker also incorporates an improved port.

While the invention is shown in only one of its forms, it is not thus limited but is susceptible to various changes and modifications without departing from the spirit and scope of the invention.

What is claimed is:

1. A loudspeaker unit for a line array of neighboring loudspeaker units held in a plane of alignment, each loudspeaker unit comprising:

a housing;

a planar acoustical transducer having length and breadth disposed with respect to the housing to extend lengthwise from near one side of the housing to near an opposite side of the housing in parallel with the plane of alignment; and a tuned rear chamber disposed behind the planar acoustical transducer including a reflection canceling surface defining the back of the tuning chamber; and a low frequency acoustical driver mounted with respect to the housing.

2. A loudspeaker unit for a line array as set forth in claim 1, further comprising:

the housing having front and back faces;

a bass-reflex enclosure defined by the housing having a forward directed port through the front face;

the low frequency acoustical driver being positioned in the front face;

the planar acoustical transducer being positioned parallel to and in front of the front face; and an indent in the front face behind the planar acoustical transducer forming the tuned rear chamber for the planar.

3. A loudspeaker unit as claimed in claim 2, further comprising:

parallel sides perpendicular to and connected between the front and back faces; and the housing having a trapezoidal cross-sectional shape perpendicular to the front and back faces of the housing and parallel to the parallel sides.

4. A loudspeaker unit assembly as claimed in claim 3, further comprising:

the forward directed port comprising an elongated rectangular passage having varying side to side and top to bottom dimensions to conform to exterior walls of the trapezoidal housing while maintaining a substantially constant cross-sectional area from end to end of the forward directed port.

5. A loudspeaker unit as claimed in claim 4, further comprising:

the indent comprising two walls intersecting along a line at an angle of between 30 degrees and 60 degrees to form a cavity behind the planar acoustical transducer, the line formed being parallel to the plane of alignment and spaced from the planar acoustical transducer by one quarter of the wavelength of a designed lower frequency limit for output from the planar acoustical transducer; and sound dampening material in the cavity.

6. A loudspeaker unit as claimed in claim 5, wherein the loudspeaker unit is incorporated in a linear array of a plurality of the loudspeaker units.

7. A loudspeaker unit as claimed in claim 1, further comprising:

the tuned rear chamber being formed behind the planar acoustical transducer by two converging vertical walls intersecting at an angle of between 30 degrees and 60 degrees to form a cavity behind planar acoustical transducer, the vertical walls and the planar forming a triangle with the depth of one quarter of the wavelength of a designed lower frequency limit for output from the planar acoustical transducer; and sound dampening material in the cavity.

8. A loudspeaker unit as claimed in claim 7, wherein the loudspeaker unit is incorporated in a linear array of a plurality of the loudspeaker units.

9. Apparatus comprising:

a housing defining an interior space and having first and second sides, the first and second sides being spaced from and parallel to one another and being trapezoidal in shape, each with a base edge positioned at the front of the housing and upper and lower converging sides oriented toward the top and bottom of the housing, a front face positioned between the base edges of the first and second sides, a rear face positioned between edges of the first and second sides opposite the base edges, and a cover and a base positioned respectively between the upper and lower converging edges of the first and second sides such that the cover and base have a maximum spacing with the interior space adjacent the front face and a minimum spacing adjacent the rear face;

an aperture in the front face for a loudspeaker cone;

an elongated port open to the interior space and through the front face, the top and bottom of the elongated port being defined by portions of interior faces of the cover and the base; and sides to the elongated port which converge from back to front of the port to maintain a constant cross-sectional area in the elongated port from back to front of the port.

10. An apparatus as claimed in claim 9, further comprising:

the elongated port having as one side an interior face of the one of the sides of the housing; and a second side provided by an interior baffle which diverges from the interior face from front to back to maintain a substantially cross sectional area.

11. An apparatus as claimed in claim 10, further comprising:

an indentation in the front face running from an edge of the front face adjacent the cover to an edge of the front face adjacent the base and angled with respect to the front face; and a planar acoustical transducer positioned over the indentation to generate a null standing wave over the operating frequency of the planar acoustical transducer within the indentation.

12. An apparatus as claimed in claim 11, further comprising:

sound absorbing material between the planar acoustical transducer and the sides of the indentation.

13. An apparatus as claimed in claim 12, further comprising:

the indentation having first and second intersecting sides having an angle of intersection of between 30 and 60 degrees and a maximum depth from the planar acoustical transducer at the point of intersection of one quarter of a wavelength at a lower knee frequency.

14. An apparatus as claimed in claim 13, further comprising:

a low frequency loudspeaker with a cone disposed in the aperture.

15. A multi-transducer loudspeaker assembly for use in a line array, comprising:

a trapezoidal housing;

a low frequency cone woofer mounted with respect to the trapezoidal housing an acoustically tuned rear chamber indent running in the direction of extension of the line array defined by the trapezoidal housing; and a planar acoustical transducer mounted to the front of the housing over the acoustically tuned rear chamber.

16. A multi-transducer loudspeaker assembly for use in a line array as set forth in claim 15, further comprising:

the trapezoidal housing defining a bass-reflex enclosure;

the trapezoidal housing being narrower at the back than at its front; and the low frequency cone woofer being mounted in an aperture in a front face of the bass-reflex enclosure.

17. A multi-transducer loudspeaker assembly for use in a line array as set forth in claim 16, further comprising:

a port from the bass-reflex enclosure aligned from back to front of the enclosure with constantly varying width and height and a constant cross sectional area along its entire length.

* * * * *